US010049541B2

(12) United States Patent
Ewen, III et al.

(10) Patent No.: US 10,049,541 B2
(45) Date of Patent: Aug. 14, 2018

(54) DONGLE, SYSTEM, AND/OR METHOD FOR SECURING AN ELECTRONIC DEVICE

(71) Applicant: Sennco Solutions Inc., Plainfield, IL (US)

(72) Inventors: John E. Ewen, III, Aurora, IL (US); Sean P. Behan, Yorkville, IL (US)

(73) Assignee: Sennco Solutions Inc., Plainfield, IL (US)

( * ) Notice: Subject to any disclaimer, the term of this patent is extended or adjusted under 35 U.S.C. 154(b) by 0 days.

(21) Appl. No.: 15/253,485

(22) Filed: Aug. 31, 2016

(65) Prior Publication Data

US 2016/0371945 A1 Dec. 22, 2016

Related U.S. Application Data

(63) Continuation of application No. 13/565,397, filed on Aug. 2, 2012, now abandoned.

(51) Int. Cl.
*G08B 13/14* (2006.01)

(52) U.S. Cl.
CPC ..... *G08B 13/1418* (2013.01); *G08B 13/1445* (2013.01)

(58) Field of Classification Search
CPC ..... G08B 13/1489; G08B 13/1445; G08B 13/14; G08B 13/1418
USPC ..... 340/539.11, 541, 568.1, 568.2, 568.3, 340/568.8, 571, 573.3; 248/176.1
See application file for complete search history.

(56) References Cited

U.S. PATENT DOCUMENTS 3,875,341 A * 4/1975 Gassmann ..... G10L 21/038 704/205
4,408,169 A * 10/1983 Fraser ..... H03K 7/06 331/111
5,978,084 A * 11/1999 Blake ..... G01C 19/72 356/460
6,459,374 B1 * 10/2002 Rand ..... G08B 13/1418 340/568.2
2008/0219464 A1 * 9/2008 Smith ..... A61B 7/04 381/67
2008/0266089 A1 * 10/2008 Haren ..... G06F 21/88 340/568.1
2010/0301998 A1 * 12/2010 Marszalek ..... G08B 13/1445 340/5.65
2011/0084689 A1 * 4/2011 Groth ..... G01R 31/026 324/119
2013/0307692 A1 * 11/2013 Fawcett ..... G08B 13/1445 340/568.2

* cited by examiner

*Primary Examiner* — Hung T Nguyen
(74) *Attorney, Agent, or Firm* — Lempia Summerfield Katz LLC

(57) ABSTRACT

An apparatus, a system and/or a method provide an alarm, power and/or use of an electrical device. A dongle, a sensor, a cable, and/or an alarm may implement capacitive sensing technology to deter theft and/or a removal of the electronic device from an electrical connection. The electronic device may be on display and/or may be used, manipulated, tested and/or transported by users in an environment, such as a retail store. The sensor may incorporate an alarm that may enable a signal when the electronic device is unplugged therefrom.

19 Claims, 3 Drawing Sheets

FIG.3A
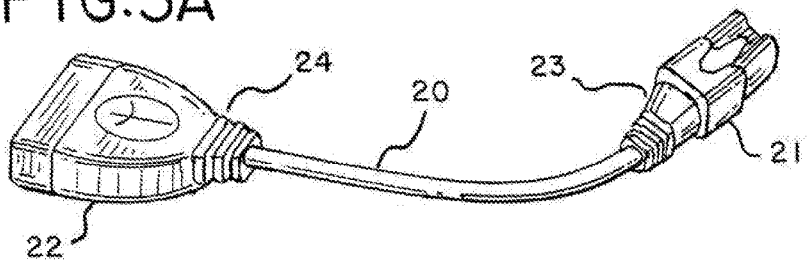
FIG.3B
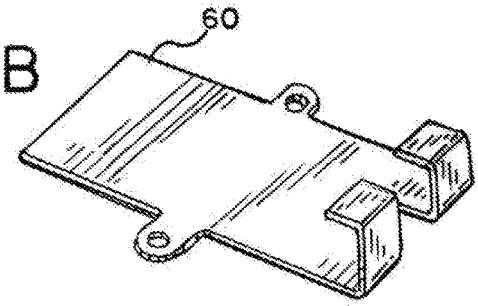
FIG.3C
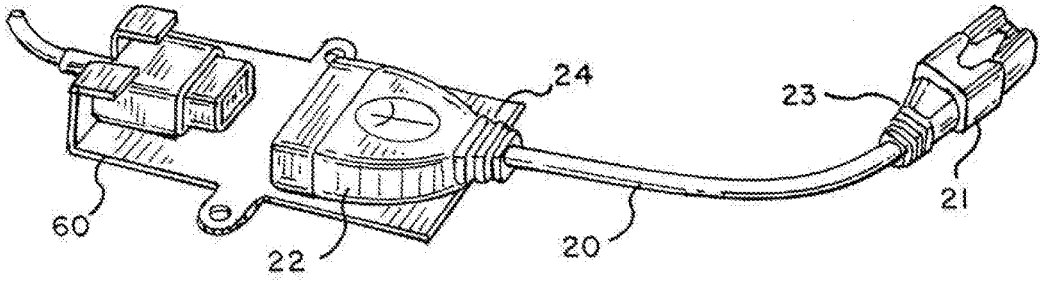
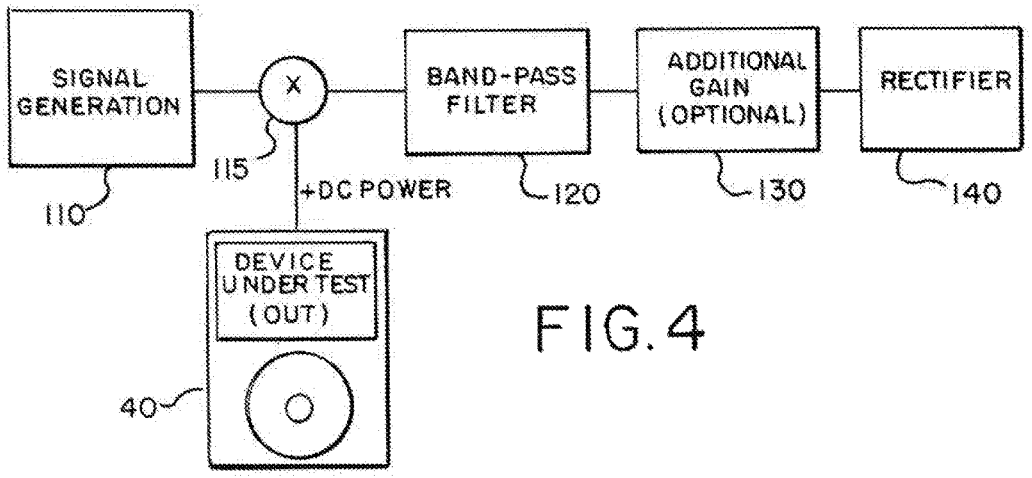
FIG.4

DONGLE, SYSTEM, AND/OR METHOD FOR SECURING AN ELECTRONIC DEVICE

CROSS-REFERENCE TO RELATED APPLICATIONS

This application is a continuation application of and claims the benefit of pending U.S. application Ser. No. 13/565,397 filed Aug. 2, 2012. The disclosure of which is hereby incorporated by reference.

BACKGROUND OF THE INVENTION

The present invention generally relates to an apparatus, a system and/or a method for securing an electronic device. More specifically, the present invention relates to an apparatus, system and/or a method that may be used to provide theft-deterrence, power and/or use of an electronic device. The apparatus may have a dongle, a sensor, and/or an alarm. The sensor and/or the system may use capacitive sensing technology to prevent theft and/or removal of an electronic device from an environment. The electronic device may be on display and/or may be used, manipulated, tested and/or transported by consumers in an environment, such as, for example, a retail store. The apparatus may incorporate an alarm that may sound when the electronic device is unplugged therefrom.

Capacitive sensing technology in electronics is known in the art. The operation of capacitive sensing technology is based on capacitive coupling. Capacitive coupling involves the transfer of energy within an electrical network by using the capacitance existing between circuit nodes. In its basic form, capacitive coupling is usually enabled by placing a capacitor in series with the signal to be "coupled".

Capacitive sensors may be set up via electrical circuitry. Capacitive sensors essentially operate by measuring a frequency or duty cycle which is changed by the introduction of additional capacitance. Capacitive sensors may be used to detect any article that is conductive or has a dielectric different from that of air. That is, any article that insulates or resists the flow of an electric charge at a different resistivity level.

An example of a capacitive sensor or switch is a touch lamp. The metal exterior of the lamp has a nominal capacitance, the frequency of which is constantly measured. The frequency is produced using an RC oscillator and measured using a timer. When a person touches the metal, the additional capacitance of the finger changes the total capacitance. The electrical circuit of the lamp is configured to detect this change in capacitance and respond by powering the bulb on or off. The press of the finger is detectable due to the introduced 'capacitor' from metal-finger-ground which is in parallel to the natural parasitic capacitance of the circuit. The circuit employs capacitors in parallel so a finger approaching metal increases the total capacitance. This change is governed by the following equation:

$$\Delta C=((C_p+C_f)-C_p)/C_p=C_f/C_p \quad \text{Eq. 1}$$

where $C_p$ is the nominal capacitance, and $C_f$ is the capacitance of the finger. This change establishes the criteria needed to detect that a finger introduces additive capacitance causing a shift in a time constant of the RC oscillator. Increasing the RC time constant decreases the frequency of the oscillator. The decrease in frequency is a change detectable in the micro-controller.

Thus, the operation of the capacitive sensor is contingent upon the configuration of the resistor-capacitor ("RC") oscillator. A typical oscillator arrangement involves two comparators. These comparators are set at the upper and lower limits of the voltage of the circuit. The capacitor is charged and discharged at a rate determined by the RC time constant and a charge between an upper limit and a lower limit that is set by the comparators. The time required to charge from the lower limit to the upper limit and discharge back to the lower limit is the period of the oscillator.

The rate of this constant charging and discharging is the frequency of the capacitor. This frequency is constantly monitored to detect a drop in frequency caused by a finger press or any other stimulus introduced into the capacitor circuit.

Capacitive sensors have become more sophisticated. Their application in electronics, from computer mice to touch screens, is widespread. The consumer electronics retail market has grown exponentially. Technological advancements have resulted in the introduction of a plethora of different electronic devices. Consumers prefer to try using an electronic device before committing to buying the same. As a result, retail stores have introduced interactive product displays by which consumers may handle the electronic device before purchasing. Allowing consumers to demo the electronic device inevitably leads to security concerns due to the cost of the electronic devices. Thus, security devices have been introduced which affix a cable to a device to be displayed. The cable often requires an adapter to be fixed onto the device. Furthermore, the cables which secure the device often prevent a customer and/or a user from manipulating and/or examining the device. The device is often fixed to a surface of the fixture. Accordingly, the customer and/or the user may not be able to pick up and/or to move the device for examination. Therefore, the customer is unable to examine various characteristics of the device, for example, the weight, the texture, the feel, the configuration, and/or the like.

The constant usage of the displayed device inevitably drains the battery. Many security devices are unable to charge the electronic devices. Moreover, each device requires a specific charging voltage, such as, for example, five volts to operate without damaging the device. Often, the power cable contains electrical wires which attach directly to the device. However, each electrical wire may only deliver a single voltage, such as, for example, three volts, five volts, or seven volts. Therefore, only one pair of electrical wires provides the specific voltage required by the device. As a result, different pairs of electrical wires must be provided and/or utilized with each device which requires a different voltage. Having to attach a different pair of wires to each device is inconvenient and/or is burdensome.

A need, therefore, exists for a dongle, a system and/or a method for deterring theft of electronic devices. Additionally, a need exists for a dongle, a system and/or a method that may allow for simultaneous charging and securing of electronic devices. Further, a need exists for a dongle, a system and/or a method that may allow for charging of electronic devices using original equipment manufacturer ("OEM") cables. Still further, a need exists for a dongle, a system and/or a method that may sound an alarm when an electronic device is unplugged from a cable and/or the dongle. Still further, a need exists for a dongle, a system and/or a method that may allow for the unhindered display of electronic devices. Still further, a need exists for a dongle, a system and/or a method that may provide a minimalistic aesthetic quality to a display for securing electronic devices. Still further, a need exists for a dongle, a system and/or a method that may have interchangeable components to allow for customization of a security solution. Still further, a need exists for a dongle, a system and/or a method that may be adapted for use with existing cables accompanying electronic devices. Still further, a need exists for a dongle, a system and/or a method that may allow the security device to be quickly and/or easily installed, replaced and/or exchanged. Still further, a need exists for a dongle, a system and/or a method that may accommodate various OEM connectors.

SUMMARY OF THE INVENTION

The present invention relates to an apparatus, a system and/or a method that may be used to provide theft-deterrence, power, manipulation, testing and/or maneuvering of an electronic device. The electronic device may be a portable device, such as, for example, an e-reader, a digital camera, a compact disc player, a MP3 player, a PDA, a laptop computer, a cellular telephone and/or the like. The apparatus and/or system may have a dongle, a sensor, and/or an alarm. The sensor and/or the dongle may use capacitive sensing technology to prevent theft and/or a removal of a portable electronic device from a cable. The electronic device may be displayed and/or may be used, manipulated, tested and/or transported by consumers in an environment, such as, for example, a retail store. The apparatus may incorporate an alarm that may sound when the electronic device is disconnected therefrom. The apparatus, the sensor, and/or the dongle may be used to secure and/or accommodate multiple types of electronic devices without requiring modification.

The apparatus, the system and/or the method may have a dongle that is attachable to the electronic device. The apparatus may have a dongle and/or a sensor. The dongle may have a first end and a second end with a corresponding first plug and second plug. The first end of the dongle may be connected in communication with the electronic device and/or a cable associated with an electronic device. The second end of the dongle may be electrically connected to a sensor, a capacitive sensing circuit, and/or an alarm system for monitoring the electric state of the electronic device. The sensor may have a capacitive sensing circuit, a microcontroller, a power supply, and/or an alarm.

A user may maneuver the electronic device in a vicinity of the dongle and/or the cable. When the user uncouples the electronic device from the dongle, the cable, and/or the sensor, an alarm may be triggered. The alarm may emit an alarm sound and/or other signal indicative of an alarm condition.

To this end, in an embodiment of the present invention, an apparatus for securing an electronic device is provided. The apparatus has a dongle having a first connector and a second connector wherein the second connector is coupled to the electronic device. Further, the apparatus has a capacitive sensing circuit for receiving the first connector of the dongle wherein the capacitive sensing circuit detects presence of capacitance of the electronic device.

In an embodiment, the apparatus has an alarm electrically coupled to the capacitive sensing circuit wherein the alarm sounds upon a change in capacitance.

In an embodiment, the capacitive sensing circuit has a power input for providing electricity to the electronic device, the alarm, and the capacitive sensing circuit.

In an embodiment, electricity is provided to the electronic device from the capacitive sensing circuit via the dongle.

In an embodiment, the first connector is a universal serial bus connector.

In an embodiment, the apparatus has a lock bracket for keeping the first connector of the dongle coupled to a cable of the electronic device.

In another embodiment, a method for securing an electronic device is provided. The method has the step of providing a dongle and a sensor wherein the dongle has a first end and a second end wherein the sensor has a first electrical port to receive the second end of the dongle and further wherein the sensor sounds an alarm upon detecting a change in capacitance via the first electrical port. Further, the method has the steps of attaching the first end of the dongle to the electrical input of the sensor and attaching the second end of the dongle to the electronic device.

In an embodiment, the method has the step of attaching an electrical connector to a second port of the sensor wherein the electrical connector provides electricity to the electronic device via the dongle.

In an embodiment, the method has the step of providing a key operable to cease sounding of an alarm wherein the key is presented to a corresponding lock associated with the sensor.

In another embodiment, a system for deterring theft of an electronic device is provided. The system has a dongle having a first end and a second end wherein the first end is in electrical communication with the electronic device. Further, the system has a capacitive sensing circuit in electrical communication with the second end of the dongle wherein the capacitive sensing circuit sends a high frequency signal to the electronic device via the dongle. Moreover, the system has an alarm in electrical communication with the capacitive sensing circuit wherein the alarm sounds if the high frequency signal is not filtered.

In an embodiment, the system has a cable for connecting the first end of the dongle to the electronic device.

In an embodiment, the cable is provided by an original equipment manufacturer of the electronic device.

In another embodiment, a method for securing an electronic device is provided. The method has the step of generating a constant first signal having a known frequency. Further, the method has the step of modulating the first signal onto a positive rail of the electronic device. A returned second signal may be received from the electronic device, and a determination is made if a frequency of the second signal is within a range of the first signal. The range may be within 24% of the known frequency of the first signal.

In an embodiment, the method has the step of triggering an alarm if the frequency of the second signal is within 24% of the known frequency of the first signal.

In an embodiment, the steps of generating, modulating, and/or receiving are carried out by a capacitive sensing circuit.

In an embodiment, the capacitive sensing circuit has a signal generator, a band-pass filter, and/or a rectifier.

In an embodiment, the capacitive sensing circuit has a signal generator, a band-pass filter, a rectifier, and/or an amplifier.

It is, therefore, an advantage of the present invention to provide an apparatus, a system and/or a method for securing an electronic device.

Another advantage of the present invention is to provide an apparatus, a system and/or a method for securing an electronic device that may be used to allow manipulation, testing and/or maneuvering of an article with respect to a fixture.

And, another advantage of the present invention is to provide an apparatus, a system and/or a method that may be used to prevent a theft and/or a removal of the electronic device, such as, for example, a portable electronic device.

Yet another advantage of the present invention is to provide an apparatus, a system and/or a method for securing and/or charging an electronic device that may be part of an alarm apparatus for monitoring the electronic device.

A further advantage of the present invention is to provide an apparatus, a system and/or a method for securing and/or charging an electronic device that may enable an alarm when the electronic device is disconnected from the apparatus.

Moreover, an advantage of the present invention is to provide an apparatus, a system and a method for securing and/or for monitoring a device which provides a voltage to the device corresponding to a required operational voltage of the device.

And, another advantage of the present invention is to provide an apparatus, a system and a method for securing and/or for monitoring a device which provides a voltage to the device.

Yet another advantage of the present invention is to provide an apparatus, a system and a method for securing and/or for monitoring a device which allows the device to be removed from the fixture and/or examined by a customer and/or a user.

A still further advantage of the present invention is to provide an apparatus, a system and a method for securing and/or for monitoring a device which allows the device to be moved from the fixture within a predetermined distance.

Moreover, an advantage of the present invention is to provide an apparatus, a system and a method for securing and/or for monitoring a device which provides a microcontroller and/or a programmable power supplier in communication with a power source.

And, another advantage of the present invention is to provide an apparatus, a system and a method for securing and/or for monitoring a device which provides electrical security with a cable attached to the device.

Moreover, an advantage of the present invention is to provide an apparatus, a system and a method for securing and/or for monitoring a device which provides a programmable power supplier to send a voltage to the device.

Yet another advantage of the present invention is to provide an apparatus, a system and/or a method for securing and/or charging an electronic device that may be mounted in association with a display to secure the electronic device to the display.

A further advantage of the present invention is to provide an apparatus, a system and a method for securing and/or for monitoring a device which provides mechanical security and/or electrical security for more than one device.

Moreover, an advantage of the present invention is to provide an apparatus, a system and a method for securing and/or for monitoring a device which provides a programmable logical device to control a voltage delivered from a power source to the device.

A still further advantage of the present invention is to provide an apparatus, a system and/or a method for securing and/or charging an electronic device that may provide a minimalistic aesthetic quality to a display for securing an electronic device.

Moreover, an advantage of the present invention is to provide an apparatus, a system and/or a method for securing and/or charging an electronic device that may have interchangeable components to allow for customization of a security solution.

Yet another advantage of the present invention is to provide an apparatus, a system and/or a method for securing and/or charging an electronic device that may allow the dongle and/or the sensor to be quickly and/or easily installed, replaced and/or exchanged.

Moreover, an advantage of the present invention is to provide an apparatus, a system and/or a method for securing and/or charging an electronic device that may accommodate various types of electronic devices.

Additional features and advantages of the present invention are described in, and will be apparent from, the detailed description of the presently preferred embodiments and from the drawings.

BRIEF DESCRIPTION OF THE DRAWINGS

FIGS. 3A, 3B and 3C illustrate a perspective views of a dongle and a lock bracket of the apparatus and system shown in FIG. 1.

FIG. 4 illustrates a block diagram of electrical components used in an embodiment of the present invention.

DETAILED DESCRIPTION OF THE PRESENTLY PREFERRED EMBODIMENTS

The present invention relates to an apparatus, a system and/or a method that may be used to provide theft-deterrence, power, manipulation, testing and/or maneuvering of an electrical device. The apparatus may have a dongle and/or a sensor. The sensor may use capacitive sensing technology to prevent a theft and/or an uncoupling of a portable electronic device from the dongle and/or a cable. The electronic device may be on display and/or may be used, manipulated, tested and/or transported by consumers in an environment, such as, for example, a retail store. The sensor may incorporate an alarm that may be enabled if the electronic device is disconnected therefrom.

Figure 1:
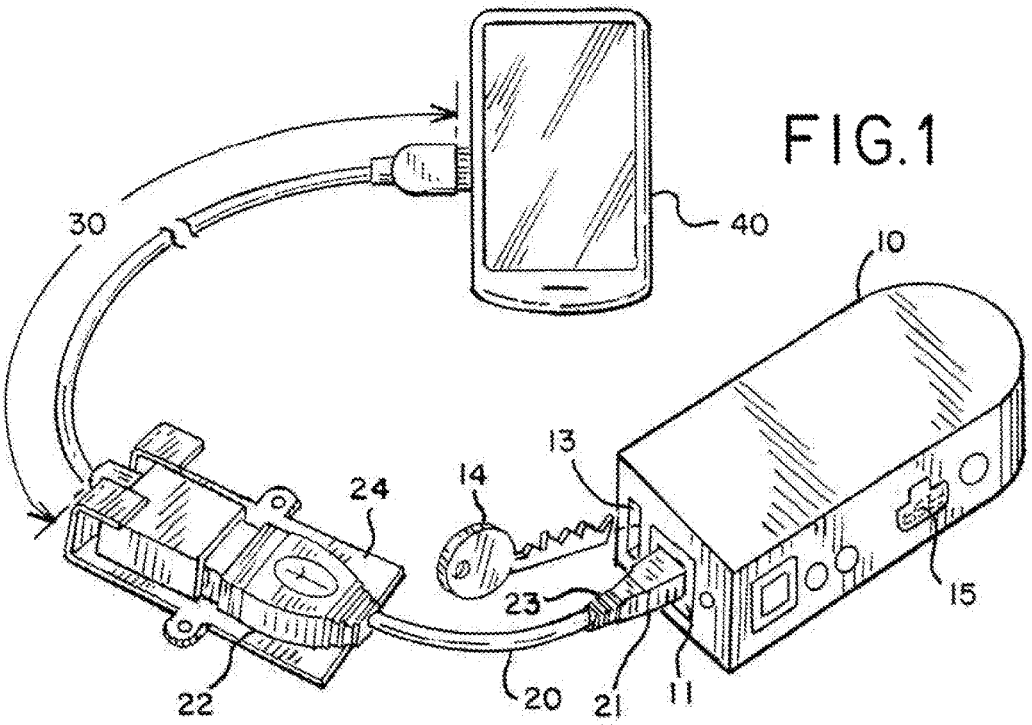
FIG. 1 illustrates a perspective view of an apparatus and a system for deterring theft of an electronic device in an embodiment of the present invention.

Referring now to the drawings wherein like numerals refer to like parts, FIG. 1 illustrates a sensor 10 and a dongle 20. The sensor 10 may be electrically coupled to an electronic device 40 in an embodiment of the present invention. The electronic device 40 may be a portable electronic device, such as, for example, a laptop computer, a tablet computer, an e-reader, a portable hard drive, a peripheral computer device, a printer, a television, a computer monitor, a cellular telephone, an mp3 player, a camera, a camcorder, a personal digital assistant (PDA), a gaming device, a hand-held global positioning system (GPS), a laptop computer, a satellite radio, a remote control and/or the like. The electronic device 40 may be on display and/or may be used, manipulated, tested and/or transported by a consumer or consumers in an environment, such as, for example, a retail store. The present invention should not be deemed as limited to a specific embodiment of the electronic device 40. It should be understood that the electronic device 40 may be any portable electronic device that may be sold and/or displayed in an environment offering any article, product and/or other merchandise as known to one having ordinary skill in the art. Moreover, it should be understood that the electronic device 40 may be any device that uses electrical power and/or battery technology associated with the presence and/or flow of electric charges.

In an embodiment, the sensor 10 and the dongle 20 may be coupled to the electronic device 40 using a provided original equipment manufacturer ("OEM") cable 30, charger cable, and/or data cable. The present invention should not be deemed as limited to a specific embodiment of the OEM cable 30. It should be understood that the OEM cable 30 may be any electronic cable that may be compatible with the particular electronic device 40 as known to one having ordinary skill in the art. Thus, the OEM cable may be manufactured and/or provided by the manufacturer of the electronic device 40, a third-party manufacturer, and/or the manufacturer of the sensor 10 and/or the dongle 20.

The dongle 20 may be part of an apparatus for tethering, monitoring and/or charging of the electronic device 40. The dongle 20 may have a length defined between a first end 23 and a second end 24 that may be positioned opposite to the first end. The first end 23 of the dongle 20 may have a first plug 21, such as, for example, a multiple circuit connector, a registered jack connector, an electrical plug, a USB plug and/or the like for electrically and/or mechanically connecting the dongle 20 to the sensor 10, a coupling, and/or another cable. The second end 24 of the dongle 20 may have a second plug 22, such as, for example, a registered jack connector, an electrical plug, a USB plug and/or the like for electrically connecting and/or mechanically connecting the dongle 20 to the OEM cable 30 of the electronic device 40. The dongle 20 may have, for example, electrical wires and/or mechanical tethering wires within a cable jacket, such as, for example, a plastic insulating sheath.

The sensor 10 may have a first electrical port 11 for receiving a first plug 21 of the dongle 20. The sensor 10 may also have a capacitive sensing circuit, the details of which will be described in more detail with respect to FIGS. 3A, 3B, 3C and 4-6. Additional electric ports may be associated with the sensor 10 for accommodating a power supply, additional dongles, and/or additional cables.

Further, the sensor 10 may have an alarm connected thereto. The sensor 10 may be operable to detect changes in the state of a connected electronic device 40. Such changes in state may include the uncoupling/coupling of the connections from the electronic device 40 to the OEM cable 30, the OEM cable 30 to the dongle 20, and/or the dongle 20 to the sensor 10. The sensor 10 may also detect whether the electronic device 40 is on and/or off. Upon detection of such changes, the alarm may emit a signal that may produce, for example, a sound, such as an alarm signal. An alarm key assembly may be provided for toggling the state of the alarm. An alarm key lock 13 may be provided on a surface of the sensor 10. The alarm key assembly may have a key 14 and/or a corresponding lock 13 on the sensor 10. The key 14 may be inserted into and/or presented to the lock 13 to program and/or to control an alarm state of the alarm system. The sensor 10 may also have a power input port 15 for powering the sensor 10, the capacitive sensing circuit, and/or the electronic device 40. The power input port may use a power supply adapted to operate on AC and/or DC.

Figure 2:
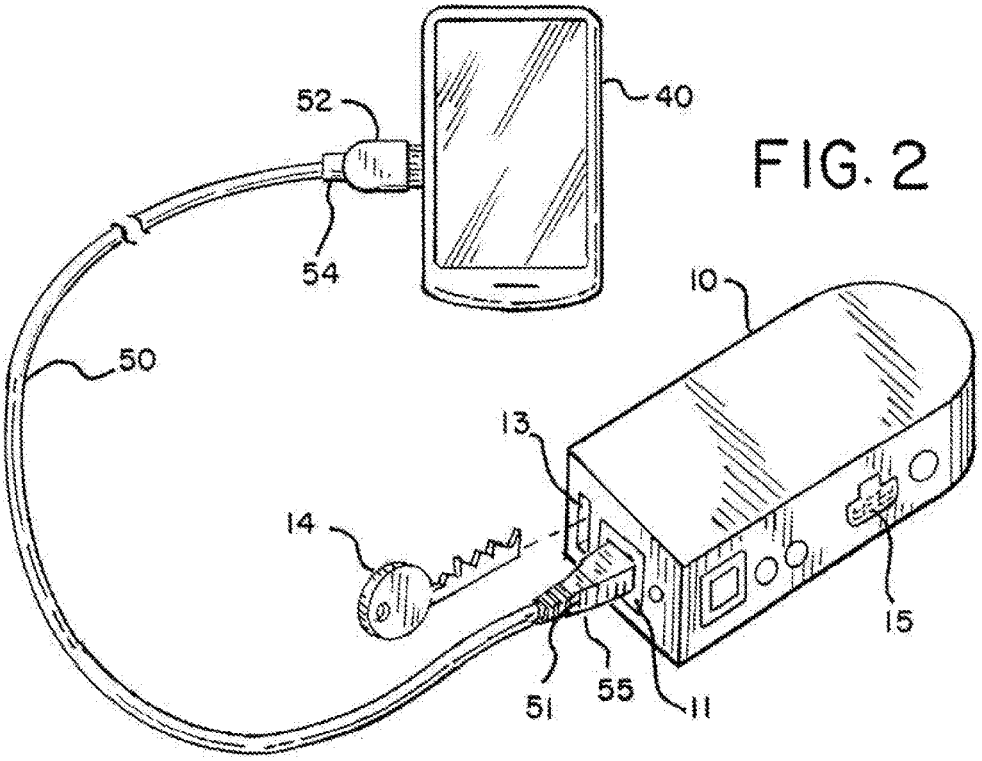
FIG. 2 illustrates a perspective view of an apparatus and a system for deterring theft of an electronic device in another embodiment of the present invention.

FIG. 2 illustrates the sensor 10 and an OEM cable 50. The sensor 10 may be electrically coupled to an electronic device 40 using the cable 50 in an embodiment of the present invention. The cable 50 may have a length defined between a first end 53 and a second end 54 that may be positioned opposite to the first end 53. The first end 53 of the cable 50 may have a first plug 51, such as, for example, a USB connector. The second end 54 of the cable 50 may have a second plug 52, such as, for example, a USB plug and/or the like for electrically and/or mechanically connecting the cable 50 to an input port of the electronic device 40. In this embodiment, the circuitry of the dongle 20 of FIG. 1 is incorporated into the sensor 10. Thus, the need for the dongle 20 in this embodiment is alleviated. The sensor 10 of FIG. 2 is a stand-alone embodiment of the present invention.

The cable 50 may be provided with the electronic device 40 and/or provided by the original equipment manufacturer. The cable 50 may be a charger cable and/or a data cable associated with the electronic device 40. The sensor 10 may have an electrical port, such as, for example, a female USB port, for accommodating a wide range of electronic devices with USB cables and/or any other universally accepted connector commonly associated with electronic devices. Thus, it should be understood that the sensor 10 may be the only component necessary to secure an electronic device 40. Moreover, the cable 50 and the electronic device 40 may originate from a third-party.

FIGS. 3A, 3B and 3C illustrate perspective views of a dongle 20 and a lock bracket 60 of the apparatus and/or system shown in FIG. 1. FIG. 3A shows the dongle 20 of FIG. 1 in its uncoupled state. The dongle 20 may have a length defined between a first end 23 and a second end 24 that may be positioned opposite to the first end 23. The dongle 20 may be sized to any length and may have a coil and/or a retractable cable assembly. The first end 23 of the dongle 20 may have a first plug 21 that may be a multiple circuit connector. The second end 24 of the dongle 20 may have a second plug 22 that may be a USB plug and/or the like for electrically connecting and/or mechanically connecting the dongle 20 to the electronic device 40 and/or the OEM cable 30 associated with the electronic device 40. In the example shown, the second plug 22 may be a female USB connector. The present invention may use USB connectors to connect with electronic devices that employ USB connectors for purposes of charging and/or connecting to other devices, such as, for example, a personal computer. The dongle 20 may have, for example, electrical wires and/or mechanical tethering wires disposed within a cable jacket, such as, for example, a plastic insulating sheath.

FIGS. 3B and 3C show a lock bracket 60 that may be used to harness, secure, lock and/or cradle the connectors of the dongle 20 and/or the OEM cable 30. As shown, the OEM cable 30 has a male USB connector. The male USB connector of the OEM cable 30 is coupled to the second plug 22 of the dongle 20. The male USB connector may be cradled by the lock bracket 60 such that pulling of the OEM cable 30 does not result in the OEM cable and the dongle 20 becoming uncoupled. When used in a retail store environment, the lock bracket 60 simplifies the apparatus and/or the system because the alarm only sounds when the OEM cable 30 is uncoupled from the electronic device 40.

FIG. 4 illustrates a block diagram of electrical components used in an embodiment of the present invention. The diagram shown may be representative of a capacitive sensing circuit disposed within the sensor 10, the dongle 20 and/or the apparatus of an embodiment of the present invention. Generally, the capacitive sensing circuit may detect if an electronic device 40 is electrically connected to the sensor 10 and/or if the electronic device 40 is powered on. The capacitive sensing circuit may be electrically connected to a power rail and a ground rail of the electronic device 40. The power rail and the ground rail are typically accessed via an input port on the electronic device 40. Such a port may usually be provided for charging and/or connecting the electronic device 40 to another device, such as, for example, a computer.

The capacitive sensing circuitry may generate a low frequency signal on the power rail and then may detect if the low frequency signal is removed by the capacitance of the attached electronic device 40. Most electronic devices have low voltage direct current ("DC") power supplies. Low voltage DC power supplies have capacitance between the positive rail and the negative rail to provide constant steady DC power. The circuitry may function based on the maintained capacitance between the positive and negative rails. This capacitance acts as a low-pass filter removing any low frequency oscillations on the power rails of the electronic device 40. Therefore, if a device with enough capacitance is connected and a frequency is applied to the power rails, the capacitor of the electronic device 40 may filter this frequency signal. However, if an electronic device is not connected, and a low frequency signal is applied to the power rails of the device, the low frequency signal may not be filtered. Therefore, detecting the presence of a low frequency signal may indicate if a device is connected or is not connected.

Referring still to FIG. 4, the capacitive sensing circuitry may generally have several components. First, a signal generator 110 may generate a high frequency signal. Second, the high frequency signal may be modulated onto the positive DC rail of the attached electronic device 40 using a modulator 115. To minimize any effects of the high frequency signal on the attached device, the peak-to-peak magnitude of the signal may be reduced to less than the nominal positive DC rail level of the electronic device 40. For example, a 100 mV peak-to-peak value may be applied to +5V DC rail. The electronic device 40 outputs its positive DC rail and ground DC rail. DC power supplies on electronic devices have a capacitance between the power rail and ground rail. The capacitance may act as a low-pass filter and may remove any high frequency oscillations.

The band-pass filter 120 may remove any unwanted frequencies from the positive DC rail. The band-pass filter 120 may allow a signal to pass if the signal has the known high frequency generated by the signal generator 110. A signal having any other frequency may be blocked by the band-pass filter 120. Therefore, if no device is attached and, therefore, no capacitance is exerted, then the generated high frequency signal is returned. However, if a device is attached with enough capacitance, the generated high frequency signal is removed by this capacitance and is not present at the band-pass filter 120. Consequently, the band-pass filter 120 may have little to no output indicating the lack of the high frequency signal.

Next, an operational amplifier 130 may provide an optional additional gain to the output of the band-pass filter 120 to provide a larger signal for a rectifier 140. Before reaching the rectifier 140, the signal is in the form of a high-frequency alternating current ("AC"). The rectifier 140 converts the output of the band-pass filter 120 or the amplifier 130 to direct current ("DC"). If the band-pass filter 120 has a high frequency output, i.e. no electronic device connected, the rectifier 140 converts this high frequency into a known DC level. However, if the band-pass filter 120 does not have a high frequency output, i.e. electronic device connected, no AC signal is available to convert, and thus the rectifier 140 may output its nominal state. The output of the rectifier 140 may be detected to determine whether a capacitive electronic device 40 is present. This determination may be performed by a micro-controller in communication with the circuit.

Figure 5:
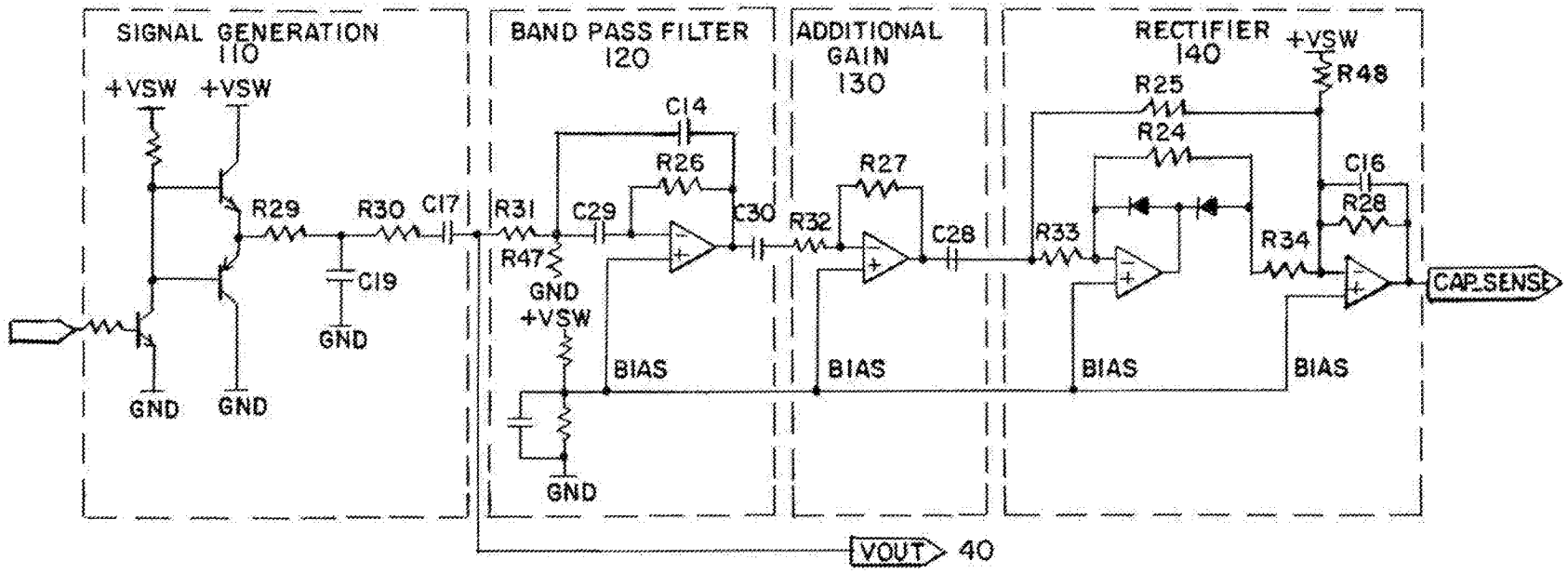
FIG. 5 illustrates a circuit diagram of electrical components shown in FIG. 4.

Referring now to FIG. 5, a circuit diagram is shown using the electrical components of FIG. 4. The circuit diagram shown in FIG. 5 is an example of a circuit arrangement for practicing the present invention. To generate the elevated frequency, a square wave may be set at a known frequency and may input into the signal generator 110. A micro-controller may generate the square wave, and the frequency may be set to 100 kHz. The square wave may be smoothed into a triangular wave as the signal passes resistors R29, R30 and capacitor C19. Capacitor C17 may reduce the magnitude of the signal before the signal is output to the electronic device 40 via $V_{out}$.

The band-pass filter 120 may employ a multi-feedback band-pass filter arrangement. The band-pass filter 120 may to have a mid-frequency ($f_m$) at the known high frequency signal generated by the signal generator 110 and a high filter quality (Q) or low bandwidth (B). This arrangement may allow only the generated high frequency signal to pass through and may remove other unwanted frequencies and/or noise; thus, only the generated high frequency signal is detected. A multi-feedback band-pass filter may also provide a set level of gain (A) to amplify the low input signal into a larger output. The filter characteristics of the band-pass filter 120 of FIG. 5 may be governed by the following equations:

$$f_m = \frac{1}{2\pi C29} \times \sqrt{\frac{R31 + R47}{R31 \times R47 \times R26}}, \quad \text{Eq. 2}$$

$$-A_m = \frac{R26}{2 \times R31}, \quad \text{Eq. 3}$$

$$Q = \pi \times f_m \times R26 \times C14, \text{ and} \quad \text{Eq. 4}$$

$$B = \frac{1}{\pi \times R26 \times C14}. \quad \text{Eq. 5}$$

The positive input into the operational amplifier 130 is a DC bias that may be set to one-half of the power supply voltage that may be supplied to the operational amplifier 130 thereby allowing for maximum AC swing at the output of the operational amplifier 130. Additionally, capacitor C30, located at the output of the operational amplifier 130, may remove any DC bias and may be relatively low in capacitance.

In an embodiment that may use the operational amplifier 130, a gain-only circuit may be used to provide additional gain (A) to the signal output by the band-pass filter 120. The gain provided by the operational amplifier 130 in FIG. 4 may be determined by the following equation:

$$A = \frac{R27}{R32}. \quad \text{Eq. 6}$$

The positive input of the operational amplifier 130 may be set to one-half of the power supply voltage that may be supplied to the operational amplifier 130 that may allow for a maximum AC swing. Likewise, capacitor C28, at the output of the operational amplifier 130, may remove any DC bias and/or may be small.

The rectifier 140 may employ an active full-wave circuit arrangement. The rectifier 140 may convert the AC signal output from the operational amplifier 130 into a DC signal. The active full-wave type of rectifier may provide a more accurate and/or a less temperature-dependent output compared to that of a standard diode rectifier circuit. The rectifier 140 of FIG. 5 may be governed by the following equation:

$$R33=R23=R24=R28=R48=2R34, \quad \text{Eq. 7}$$

where capacitor C16 is used as an integrating capacitor that may cause the output DC voltage to be proportional to the average input voltage. The capacitor C16, when used in conjunction with resistor R28, must be large enough to smooth the high frequency signal into a DC value.

The output DC value may then be transferred to any form of analog circuitry for processing. For example, a micro-controller, an analog comparator and/or an analog to digital ("A/D") converter may be used for processing. If the generated high frequency signal is present at the input of the band-pass filter 120, i.e. not enough capacitance present, this DC output may be a known set level. However, if the generated high frequency signal is not present at the input of the band-pass filter 120, i.e. enough capacitance present, this DC output may be set to its nominal level. In this example, the nominal level may be equivalent to ground. Therefore, setting a threshold value between ground and the known DC level may indicate whether the electronic device 40 is connected. In implementing embodiments of the present invention, the signal may be fed into an A/D input of the micro-controller to measure the output frequency to decide whether the electronic device 40 is connected.

Figure 6:
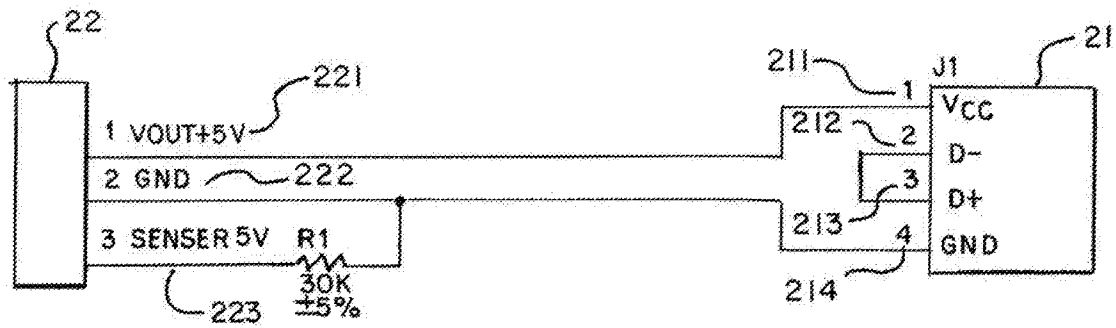
FIG. 6 illustrates a wiring schematic diagram of a dongle used in an embodiment of the present invention.

FIG. 6 illustrates a wiring schematic diagram of the dongle 20 that may be used in an embodiment of the present invention. The dongle 20 may have a length defined between a first end 23 and a second end 24 that may be positioned opposite to the first end 23. The second end of the dongle 20 may have a second plug 22. The second plug 22 may be a three pin connector as illustrated in FIG. 6. The first current, $V_{out}$ 221, is the voltage output from the capacitive sensing circuit described in FIGS. 4 and 5. The second current, GND 222, is the grounding current. A resistor may be provided from the third current 223 to GND 221 for setting the voltage output.

Referring to FIG. 6, the first plug 21 may be a Universal Serial Bus ("USB") connector that may be used for the first plug and/or the second plug of the dongle 20 and/or the OEM cable 30. Any type of USB plug may be used, including, but not limited to USB 1.0, USB 2.0, USB 3.0, Type A, Type B, Mini-A, Mini-B, Micro-A, and/or Micro-B. Moreover, the USB plug may have a male connector and/or a female connector. Generally, the USB connector may have 4 to 11 pins. Most portable electronic devices use a charging cable and/or a data cable with a type A male USB connector. This connector may be used with type A female USB ports that may be found on personal computers and/or charging transformers. The dongle 20 of the present invention may have a type A female USB connector that may be used with multiple types of electronic devices. Thus, one dongle may be used to secure various types of electronic devices.

As shown in FIG. 6, the USB connector may have four pins. The first pin 211 is the positive power rail providing voltage to the electronic device 40. The first pin 211 transmits the voltage output from the capacitive sensing circuit set forth in FIGS. 4 and 5. Thus, the existence of the electronic device 40 with capacitance may determine whether voltage of the same frequency is returned to the sensor 10. The data pins 212, 213 are shorted to allow for the use of OEM cables. Shorting the data pins 212, 213 signals to the electronic device 40 that it is connected to a charger cable and not a computer and/or any other data connection. The ground 214 may be the return path of the electric current that may be sent via the first pin 211.

In a retail environment, the dongle 20 and/or the system may be set up to secure any type of electronic device 40. To configure the system, the electronic device 40 to be secured is required along with an OEM charging and/or data cable. The sensor 10 may be placed in a desired vicinity of a display. The first plug 21 of the dongle 20 may be coupled to the cable 30 of the electronic device 40. The second plug 22 of the dongle 20 may be coupled to the sensor 10. The sensor 10 may be enabled upon the powering of the electronic device 40. The alarm signal of the sensor 10 may be enabled and/or transmitted if the electronic device 40, the dongle 20, and/or the cable 30 is unplugged. Thus, if a customer handling the electronic device 40 removes the cable 30, the alarm signal will be triggered. The alarm may emit an audible sound and/or may send a signal to a controller, computer, and/or an employee. The state of the alarm may be controlled using the key 14. Upon the triggering of the alarm, the key 14 may be presented to the lock 13 to override and/or to cease the alarm.

In another embodiment, such as that shown in FIG. 2, the sensor 10 may be placed in a desired vicinity of a display. To configure the system, the electronic device 40 to be secured is required along with an OEM charging and/or data cable 50. The first plug 51 of the cable 50 may be plugged into the input port on the sensor 10. The second plug 52 of the cable 50 may be plugged into an electrical and/or a data input port of the electronic device. The sensor 10 may be enabled upon the powering of the electronic device 40. The alarm signal of the sensor 10 may be enabled and/or transmitted if the electronic device 40 and/or the cable 50 is unplugged. Thus, if a customer handling the electronic device 40 removes the cable 50, the alarm signal will be triggered. The alarm may emit an audible sound and/or may send a signal to a controller, computer, and/or an employee. The state of the alarm may be controlled using the key 14. Upon the triggering of the alarm, the key 14 may be presented to the lock 13 to override and/or to cease the alarm.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. An apparatus for monitoring a portable electronic device provided by an original equipment manufacturer (OEM), the apparatus comprising:

a sensor unit configured to be positioned remote from the portable electronic device, the sensor unit comprising an electrical port configured for connecting the portable electronic device to the sensor unit with a cable provided by the original equipment manufacturer (OEM), wherein the sensor unit is configured to detect disconnection of the portable electronic device from the cable and to trigger an alarm condition based on detecting the disconnection, wherein the sensor unit is further configured to transmit electric power to the portable electronic device with the cable, and wherein the sensor unit further comprises a capacitive sensing circuit comprising:

a signal generator configured to generate a signal;

a modulator configured to modulate the signal for transmission onto a positive direct current power rail of the portable electronic device when the portable electronic device is connected to the cable; and a band-pass filter configured to remove unwanted frequencies from the positive direct current power rail.

2. The apparatus of claim 1, wherein the electrical port is configured to receive the cable directly from the portable electronic device.

3. The apparatus of claim 1, wherein the sensor unit further comprises:

a dongle configured for connecting the cable to the sensor unit.

4. The apparatus of claim 3, wherein the dongle is configured to receive the cable directly from the portable electronic device.

5. The apparatus of claim 1, wherein the sensor unit is configured to detect disconnection of the portable electronic device from the cable by receiving a return of the signal by the sensor unit.

6. The apparatus of claim 1, wherein the sensor unit is configured to detect disconnection of the portable electronic device by detecting if the signal is removed by a capacitance of the portable electronic device.

7. The apparatus of claim 1, wherein the sensor unit further comprises:

an operational amplifier configured to provide a gain to an output of the band-pass filter.

8. The apparatus of claim 1, wherein the sensor unit further comprises:

a rectifier configured to convert an output of the band-pass filter to direct current.

9. The apparatus of claim 1, wherein the sensor unit further comprises:

a key port configured to receive a key, wherein the sensor unit is configured to detect insertion of the key into the key port to control the alarm condition.

10. A system for securing an electronic device provided by an original equipment manufacturer (OEM), the system comprising:

a sensor configured to connect to a cable provided by the original equipment manufacturer (OEM), the sensor comprising:

a capacitive sensing circuit configured to detect whether the electronic device is connected to the cable, wherein the sensor is configured to provide an alarm if the electronic device is disconnected from the cable; and an alarm port configured to receive a key through an aperture in the sensor to deactivate the alarm, wherein the capacitive sensing circuit comprises:

a signal generator configured to generate a signal;

a modulator configured to modulate the signal for transmission onto a positive direct current power rail of the electronic device when the electronic device is connected to the cable; and a band-pass filter configured to remove unwanted frequencies from the positive direct current power rail.

11. The system of claim 10, wherein the sensor is configured to receive the cable directly from the electronic device.

12. The system of claim 10, wherein the sensor is configured to connect to the cable via a dongle between the sensor and the cable.

13. The system of claim 10, wherein the sensor is configured to simultaneously detect whether the electronic device is connected to the cable and provide power to the electronic device with the cable.

14. A method for monitoring a portable electronic device provided by an original equipment manufacturer (OEM), the method comprising:

positioning a sensor unit remote from the portable electronic device;

connecting the portable electronic device to the sensor unit with a cable provided by the original equipment manufacturer (OEM) with the portable electronic device;

generating a signal with a signal generator of a capacitive sensing circuit of the sensor unit;

modulating the signal with a modulator of the capacitive sensing circuit of the sensor unit for transmission onto a positive direct current power rail of the portable electronic device when the portable electronic device is connected to the cable;

removing unwanted frequencies from the positive direct current power rail with a band-pass filter of the capacitive sensing circuit of the sensor unit;

detecting disconnection of the portable electronic device from the cable; and triggering an alarm indicative of disconnection of the portable electronic device from the cable.

15. The method of claim 14, wherein connecting the portable electronic device to the sensor unit comprises connecting the cable directly from the portable electronic device.

16. The method of claim 14, wherein connecting the portable electronic device to the sensor unit comprises connecting a dongle between the cable and the sensor unit.

17. The method of claim 14, further comprising:

deactivating the alarm by inserting a key into a key port on the sensor unit.

18. The method of claim 14, further comprising:

transmitting power to the portable electronic device through the cable.

19. The method of claim 14, further comprising:

connecting a power supply to the sensor unit.

* * * * *